US005694007A

United States Patent [19]

Chen

[11] Patent Number: 5,694,007

[45] Date of Patent: Dec. 2, 1997

[54] DISCHARGE LAMP LIGHTING SYSTEM FOR AVOIDING HIGH IN-RUSH CURRENT

[75] Inventor: Timothy Chen, Memphis, Tenn.

[73] Assignee: Systems and Services International, Inc., Memphis, Tenn.

[21] Appl. No.: 424,956

[22] Filed: Apr. 19, 1995

[51] Int. Cl.[6] ..... H05B 37/02

[52] U.S. Cl. ..... 315/247; 315/224; 315/307; 315/DIG. 5

[58] Field of Search ..... 315/209 R, 224, 315/307, 247, DIG. 4, DIG. 5, 200 R, 219

[56] References Cited

U.S. PATENT DOCUMENTS

| | | | |
|---|---|---|---|
| 3,611,021 | 10/1971 | Wallace | 315/239 |
| 4,370,600 | 1/1983 | Zansky | 315/244 |
| 4,414,493 | 11/1983 | Henrich | 315/308 |
| 4,415,839 | 11/1983 | Lesea | 315/308 |
| 4,733,138 | 3/1988 | Peralman et al. | 315/307 |
| 4,889,999 | 12/1989 | Rowen | 307/31 |
| 4,893,059 | 1/1990 | Nilssen | 315/127 |
| 4,928,039 | 5/1990 | Nilssen | 315/209 R |
| 4,939,427 | 7/1990 | Nilssen | 315/209 R |
| 4,952,849 | 8/1990 | Fellows et al. | 315/307 |
| 4,963,793 | 10/1990 | De Pauli | 315/74 |
| 4,972,290 | 11/1990 | Sun et al. | 361/64 |
| 4,998,046 | 3/1991 | Lester | 315/209 R |
| 5,023,519 | 6/1991 | Jensen | 315/242 |
| 5,030,887 | 7/1991 | Guisinger | 315/158 |
| 5,030,892 | 7/1991 | Clegg | 315/227 R |
| 5,032,765 | 7/1991 | Nilssen | 315/97 |
| 5,041,763 | 8/1991 | Sullivan et al. | 315/176 |
| 5,043,635 | 8/1991 | Talbott et al. | 315/291 |
| 5,049,790 | 9/1991 | Herfurth et al. | 315/291 |
| 5,089,751 | 2/1992 | Wong et al. | 315/279 |
| 5,097,181 | 3/1992 | Kakitani | 315/209 R |
| 5,099,176 | 3/1992 | Fellows et al. | 315/86 |
| 5,099,407 | 3/1992 | Thorne | 363/37 |
| 5,107,184 | 4/1992 | Hu et al. | 315/291 |
| 5,111,118 | 5/1992 | Fellows et al. | 315/307 |
| 5,142,202 | 8/1992 | Sun et al. | 315/225 |
| 5,166,578 | 11/1992 | Nilssen | 315/209 R |
| 5,170,099 | 12/1992 | Ueoka et al. | 315/291 |
| 5,172,034 | 12/1992 | Brinkerhoff | 315/307 |
| 5,192,897 | 3/1993 | Vossough et al. | 315/308 |
| 5,210,470 | 5/1993 | Jones | 315/209 R |
| 5,235,254 | 8/1993 | Ho | 315/219 |
| 5,245,253 | 9/1993 | Quazi | 315/224 |
| 5,262,699 | 11/1993 | Sun et al. | 315/209 R |
| 5,309,062 | 5/1994 | Perkins et al. | 315/53 |
| 5,309,312 | 5/1994 | Wilkerson et al. | 361/79 |
| 5,321,337 | 6/1994 | Hsu | 315/219 |
| 5,323,090 | 6/1994 | Lestician | 315/291 |
| 5,327,048 | 7/1994 | Troy | 315/240 |
| 5,334,915 | 8/1994 | Ohsaki et al. | 315/307 |
| 5,336,979 | 8/1994 | Watson et al. | 315/362 |
| 5,339,009 | 8/1994 | Lai | 315/291 |
| 5,357,170 | 10/1994 | Luchaco et al. | 315/159 |
| 5,365,148 | 11/1994 | Mallon et al. | 315/194 |
| 5,367,223 | 11/1994 | Eccher | 315/97 |
| 5,471,117 | 11/1995 | Ranganath et al. | 315/247 |
| 5,491,388 | 2/1996 | Nobuyuki et al. | 315/308 |

*Primary Examiner*—Robert Pascal
*Assistant Examiner*—David Vu
*Attorney, Agent, or Firm*—Richard L. Myers

[57] ABSTRACT

A discharge lighting system includes a lighting server responsive to input power for controlling the operation of discharge lamps. An inverter in the server includes a full switching bridge having a first leg and a second leg operable at a common switching frequency but out of phase to provide for pulse width modulation and frequency variations to dim the discharge lamps. A protection circuit is provided to reduce the circulating currents resulting from an open-circuit condition. A power factor circuit includes an output capacitor which is maintained fully charged while the switching circuits are de-energized to extinguish the lamps. The charged condition of the capacitor avoids high in-rush currents when the lamps are again illuminated by activation of the switching circuit. A first tank circuit included in the inverter has a first resonant frequency which is greater than the switching frequency of the switching members. A second tank circuit associated with the lamp ballast has a second resonant frequency less than the switching frequency of the switching members.

6 Claims, 7 Drawing Sheets

170
Va
1

172
Vb
3

174
Va-Vb
M1

176
IQ3
3

178
IQ5
4

DISCHARGE LAMP LIGHTING SYSTEM FOR AVOIDING HIGH IN-RUSH CURRENT

BACKGROUND OF THE INVENTION

1. Field of the Invention

This invention relates generally to lighting systems and more specifically to discharge lighting systems for buildings.

2. Discussion of the Prior Art

Both incandescent and discharge lighting systems have been used for many years in providing controllable light within buildings. The dimming for such lighting systems has always been of interest particularly in rooms that have varying ambient light conditions, typically resulting from an abundance of windows.

In the past, dimming systems for discharge lights have included electromagnetic ballasts which have functioned primarily to regulate the power supply for the discharge lamps. More recently, high quality electronic dimming ballasts have functioned to provide variable output, high frequency, regulated power for the discharge lamps. Such electronic dimming ballasts have produced a higher power factor, lower harmonics, and a lower lamp arc current crest factor. In general they tend to operate at a higher efficiency than the electromagnetic dimming ballast of the past.

A problem associated with both of these ballast systems of the past is the high cost associated with producing and installing the systems. Historically, dimming ballasts were relegated to conference rooms, hotel meeting rooms and other specialty applications that required the ability to dim discharge lights for presentation purposes. Energy savings and economic considerations were not an issue in these specialty applications.

More recently, however, new emphasis has been placed on developing cost effective electronic dimming ballasts that can compete economically with "static" electronic ballasts. Unfortunately, there are numerous barriers to this elusive goal. First, the high quality dimming ballasts of the past have required a large number of electronic components including many inductors which are costly and not easily integrated. Even if the manufacturing cost of the electronic dimming ballast of the past could be reduced, the additional installation costs would still be required resulting in an unacceptable return on investment for the user.

In order to solve these problems, the prior art has attempted to produce a centralized DC lighting system that would reduce the cost of dimming by avoiding duplication of the AC to DC conversion within each ballast. Unfortunately, a centralized DC system requires that the entire lighting power grid of a facility be converted to DC. Consequently, the centralized systems have met with unsurmountable market resistance particularly as a retrofit for existing systems.

Other cost saving attempts to achieve dimmable systems include centralized high frequency dimming systems such as those disclosed by Spira in U.S. Pat. No. 4,207,498, Nilssen in U.S. Pat. No. 4,598,232, and Ward in U.S. Pat. No. 3,710,177. Each of these systems is deficient in one or more of the following characteristics. The system disclosed by Spira in the '498 patent includes a thyristor controlled half bridge series resonance circuit which is used as an inverter. Unfortunately, the series resonant circuitry is very sensitive to the changing load conditions which accompany the dimming of a discharge lamp. This of course complicates the control circuitry and causes higher harmonic distortion which in turn requires use of very costly high frequency distribution wiring. In addition, the slow hard switching of the thyristor and the high reverse recovery current of the external anti-parallel diodes increase the power dissipation resulting in lower system efficiency and lower reliability. Furthermore, the excessive current draw of an unloaded series resonant circuit ballast, which may be caused, for example, by lamp failure or lamp replacement, results in the destruction of the circuit and/or inverter. Some partial solutions to this problem are described by Ward, Spira and Nilssen in their aforementioned patents. In the Ward patent '177, the series resonant circuit is automatically disconnected from the high frequency voltage source if the lamp is removed from one of its socket terminals. However, this does not recognize a gas leakage situation or "end of lamp life" conditions where the cathodes may still be functional but the lamp fails to start. It also fails to recognize the condition where two lamps are in series, and cathode failure occurs at the common center connection while the two ends of the lamps are still connected to the resonant capacitor in the series resonant circuitry.

In his solution to this problem, Spira uses a thermally responsive switch which disconnects the circuit from the inverter once temperatures exceed 105° C., and reconnects the circuit when the temperature reduces to a certain level. Then the circuit continues to cycle on and off until the fault condition is corrected. This is a very unreliable solution particularly since thermal switches tend to wear out rapidly.

Similar to the Spira solution, Nilssen protects the series resonant circuitry against failure by adding a varistor voltage-limiting means. The varistor saves the circuit from immediate self destruction during open load conditions; however, in time it tends to overheat causing the leads to separate from the body of the varistor.

In the past, power inverters have been provided with switching members operable at a switching frequency to provide a pulse width modulated output signal to a lamp circuit. The lamp circuit has included a ballast tank circuit having a resonant frequency. With the switching frequency of the inventor greater than the resonant frequency of the ballast during open circuit conditions, a relatively high circulating current has produced unreasonable power dissipation in the ballast.

In the lighting systems of the past, the lamps have been turned on and off typically by way of a wall switch which interrupts the high voltage line current. When this wall switch is closed, the line voltage and current is introduced into a power factor controller which includes an output capacitor. In response to this line voltage and current, the output capacitor charges to energize the power inverter and the remainder of the lighting circuitry. If the wall switch is opened to turn the lamps off, the output capacitor in the power factor circuit is discharged. When the wall switch is closed, a high in-rush current is required to again charge the output capacitor. This in-rush current produces significant power losses and is particularly damaging to the electronic components in the power factor circuit.

Open circuit conditions are particularly damaging to discharge lighting circuits. These conditions can result when a lamp is improperly inserted, has a broken electrode or fails to start due to a gas leak. In the past, this problem has been addressed with attempts to reduce the average power dissipated in the components. Unfortunately, these solutions have greatly increased circuit complexity and cost. Furthermore, these attempts of the prior art have failed to reduce the instantaneous power dissipation which is at the core of the problem.

SUMMARY OF THE INVENTION

These problems of the prior art are overcome in the present invention which provides a highly efficient, phase shifted, zero voltage and zero current switching resonant inverter. The high efficiency of the inverter results in part due to operation near resonant frequency which thereby reduces circulating currents. In addition, the inverter produces an output power signal having a variable amplitude, as well as a variable frequency. This provides for stable dimming in the gas discharge lamps. By operating the inverter at a switching frequency which is less than the resonant frequency of the ballast tank, circulating currents can be lowered resulting in a reduction in power dissipation, for example, by a factor of three.

The invention includes an open circuit protection network which can be in the form of active fault management circuits or a passive dual resonant network. In one of the active circuits, a DC bus conveys an alert signal back to a controller which adjusts the pulse width and frequency to reduce the amplitude of the output power signal. In another active circuit, a DC offset signal is generated and reflected back to the inverter as an equal and opposite DC voltage. This signal can then be used by the controller to reduce the amplitude and frequency of the output power signal and thereby detune the resonant tank in the ballast.

In the case of the passive network, a full switching bridge is provided in the inverter along with a series/parallel resonant circuit having a resonant frequency. Component values are chosen so that this resonant frequency is less than the switching frequency which is also less than the resonant frequency of the ballast tank circuit. In this manner, the highly efficient zero current switching and zero voltage switching can be achieved while significantly reducing circulation losses in the lamp circuit due to open circuit conditions.

In one aspect of the invention, a lighting server receives input power and controls the operation of discharge lamps. The server includes an inverter having a full switching bridge disposed between the input power and the lamps, the bridge including a first leg and a second leg. First and second switching members having a first common terminal are serially connected in the first leg of the bridge. Third and fourth switching members having a second common terminal are serially connected in the second leg of the bridge. The switching members in the first leg have characteristics for being switched to different states at a predetermined frequency and a first switching phase. The switching members in the second leg have characteristics for being switched to different states at a the predetermined frequency and a second switching phase. A control signal coupled to the first leg and the second leg of the bridge switches the switching members in a manner such that the second switching phase of the second leg is different than the first switching phase of the first leg. A series/parallel resonant circuit is connected between the common terminals in the first and second legs to provide for zero voltage and zero current switching.

In another aspect of the invention, a lighting system receives input power and controls operation of a discharge lamp having an operating state and an open circuit state. The lighting system comprises an inverter disposed between the input power and the lamp and providing a power signal having characteristics including a voltage and frequency. A controller coupled to the inverter has properties for adjusting the pulse width and frequency of the power signal. A ballast disposed between the inverter and the lamp has properties including a dimming current when the lamp is in the operating state, and a first open-circuit current greater than the dimming current when the lamp is in the open-circuit state. A protection circuit responsive to the first open-circuit current in the ballast provides an alert signal when the lamp is in the open-circuit state. A controller responsive to the alert signal varies at least one of the pulse width and frequency in the power signal of the inverter in order to provide the ballast with a second open-circuit current less than the first open-circuit current.

In a further aspect of the invention, a lighting system is responsive to input power for controlling the operation of a discharge lamp having an on state and an off state. The system includes a power factor circuit receiving the input power and including an output capacitor having a charged condition associated with high in-rush current. An inverter coupled to the capacitor and the lamp circuit provides the lamp circuit with a power signal having first characteristics and second characteristics. The lamp circuit is responsible to the first characteristics of the power signal to place the lamp in the "on" state and is responsible to the second characteristics of the power circuit to place the lamp in the "off" state. The system includes means for providing the inverter with a second characteristic while maintaining the output capacitor of the power factor circuit in the charged condition. This places the lamp circuit in the off state while avoiding high in-rush current.

In still a further aspect of the invention, a lighting system receives input power in the form of line current and line voltage and controls the operation of a discharge lamp. The system includes a power inverter coupled to the input power, which provides an output power signal. A plurality of switching members are included in the power inverter and have properties for being switched at a switching frequency. The system includes a first tank circuit coupled to the switching members and having a first resonant frequency less than the switching frequency of the switching members. A second tank circuit is coupled between the inverter and the lamp and has a second frequency greater than the switching frequency of the switching members.

These and other features and advantages of the invention will become more apparent with a discussion of preferred embodiments and method steps, and reference to the associated drawings.

DESCRIPTION OF PREFERRED EMBODIMENTS

Figure 1:
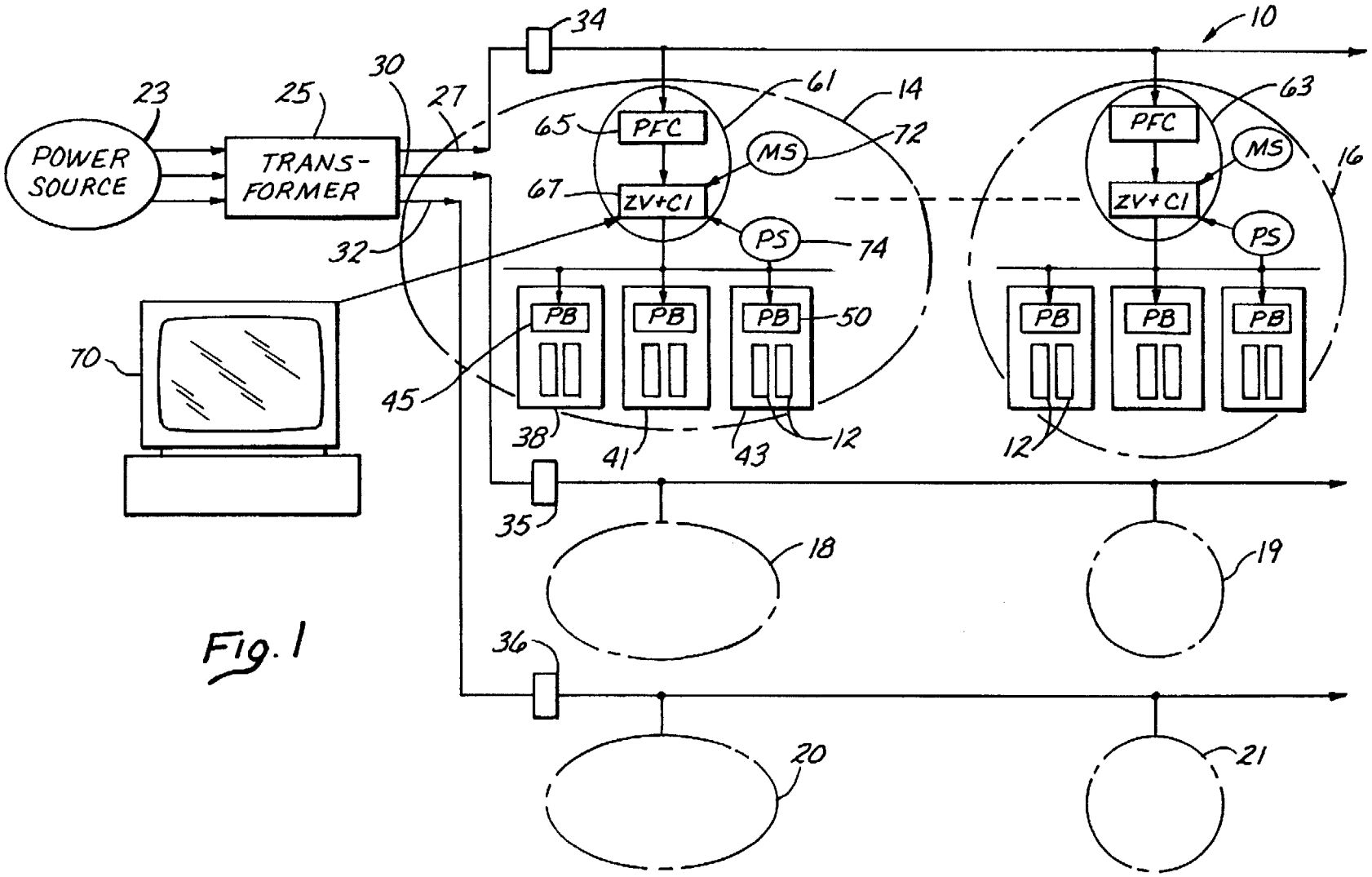
FIG. 1 is a block diagram showing one embodiment of the lighting system of the present invention connected to multiple zones of a lighting system for example in a building.

A dimmable, distributed lighting system is illustrated in FIG. 1 and designated generally by the reference numeral 10. A plurality of discharge lamps 12 are grouped into a plurality of zones defined by dotted lines 14, 16, 18 and 21 in FIG. 1. The lamps 12 in the zones 14–21 are energized by a power sources 23 providing three-phase alternating current at a voltage such as 480 volts. Although the power source 23 will typically provide an AC current and voltage, it will be understood that the lighting system 10 can also be operated from a DC power source.

The output of the power source 23 is introduced through a transformer 25 which reduces the voltage for example to 120 volts and provides a single phase output on each of three distribution conductors 27, 30 and 32. Each of these conductors 27–32 is typically provided with a circuit breaker such as those designated by reference numerals 34, 35 and 36, respectively.

The zones 14–21 will commonly be defined by groups of the associated lamps 12 which are exposed to common physical and environmental characteristics. For example, a zone will usually be defined by a single room or a portion of a large room. In this manner, the lighting control within a given zone can be customized to accommodate different environmental characteristics, such as a significant window area providing an abundance of ambient light. A zone may also be limited by the number of lamps 12 which can be accommodated by the associated circuit breaker, such as the breakers 34–36.

In the illustrated embodiment, the lamps 12 mounted in lighting fixtures such as those designated by the reference numerals 38, 41 and 43 in zone 14. Each of the fixtures 38–43 include a single lamp 12 or multiple lamps 12 as illustrated in FIG. 1. In addition to the lamps 12, the lighting fixtures 38 will commonly include an associated ballast 45, 47 and 50. It is these ballast 45–50 which are of particular interest to the invention. A wall switch 54 is provided to enable or disable the lighting server.

Also included in each of the zones 14–21 is a lighting server such as those designated by the reference numeral 61 in the zone 14 and the reference numeral 63 in the zone 16. Each of the lighting servers, such as the server 61, includes a power factor circuit 65 and an inverter 67 which can interface with a micro processor or computer 70. A motion sensor 72 can be coupled to the inverter 67 to provide an indication when the room is occupied. Similarly a photosensor 74 can be coupled to the inverter 67 to provide an indication of ambient light conditions.

Figure 2:
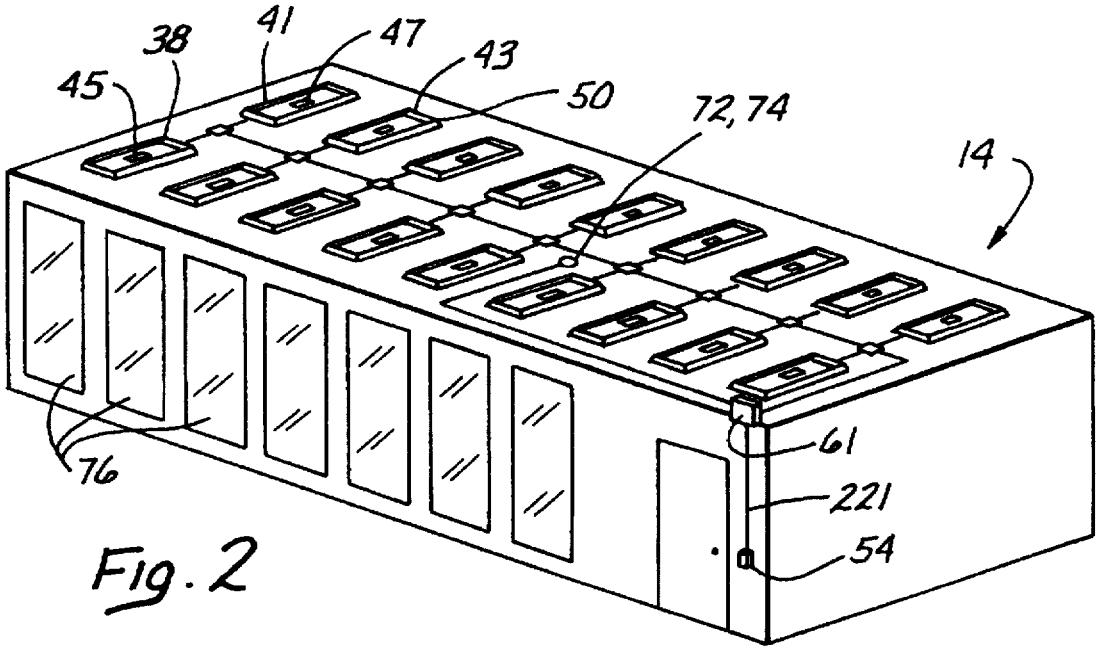
FIG. 2 is a perspective view illustrating a wall switch, lighting server, multiple light fixtures and associated ballasts in a single one of the zones illustrated in FIG. 1.

The zone 14, in the embodiment of FIG. 2 comprises a single room having multiple windows 76. Eighteen lighting fixtures including the fixtures 38–43 are operated by the single lighting server 61. Each of the lighting fixtures, such as the fixtures 38–43, is illustrated to have an associated ballast, such as the ballasts 45–50, respectively. For clarity, the lamps 12 are not illustrated in FIG. 2 but will be understood to be included in each of the fixtures, such as the fixtures 38–43. The motion sensor 72 and photosensor 74 are disposed generally centrally of the room comprising the zone 14.

Figure 3:
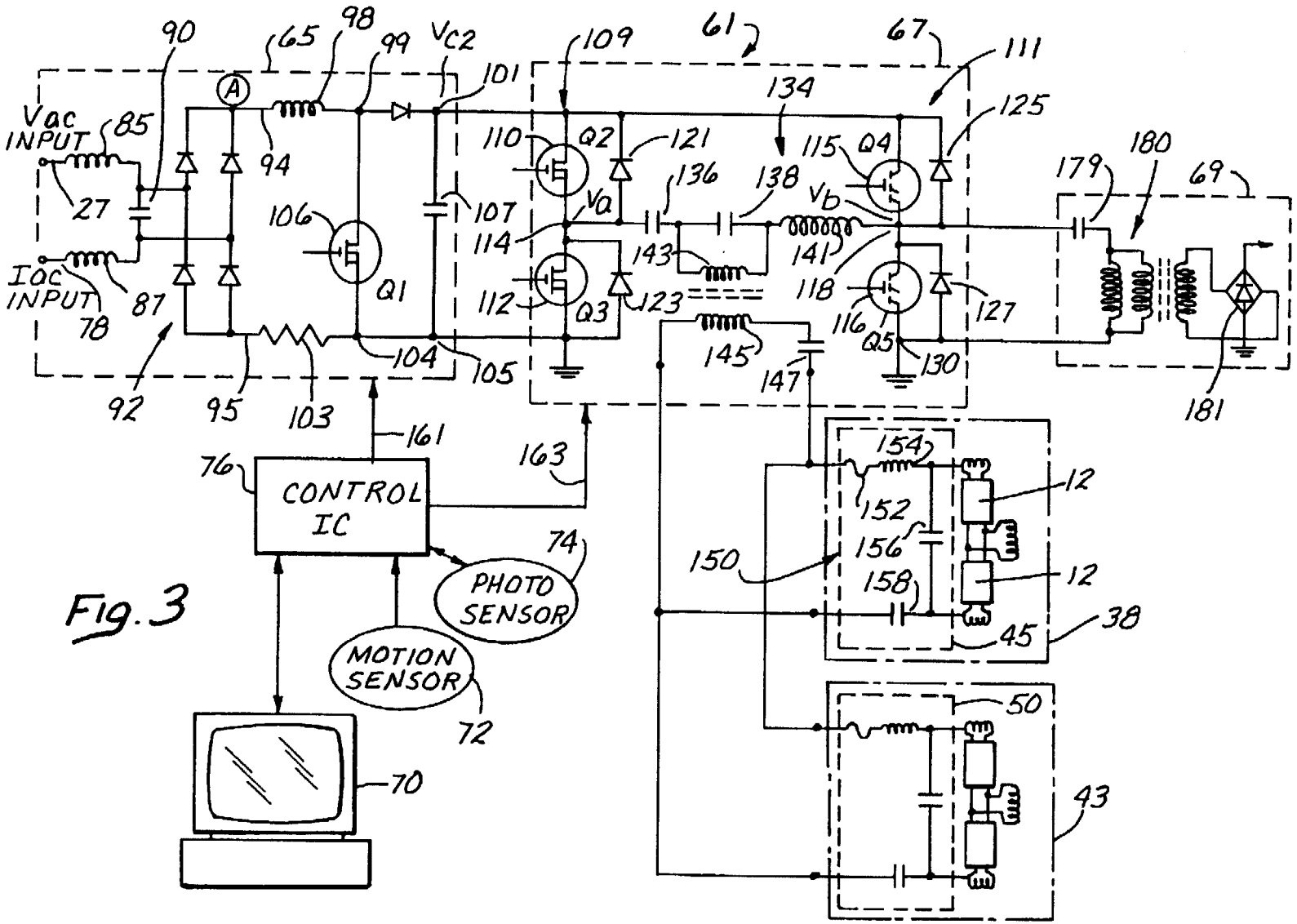
FIG. 3 is a schematic illustrating a preferred embodiment of the lighting server, including a power factor circuit and inverter, coupled to multiple lamp circuits each including a lamp ballast.

Turning now to FIG. 3, the lighting server 61 is illustrated to include the power factor circuit 65, the inverter 67, and an auxiliary DC bias circuit 69. The inverter 67 provides a power output signal to each of the lighting fixtures 38–43 which include the associated ballast 45–50. A controller 76, which interfaces with the computer 70, is included in the lighting server 61.

Figure 7:
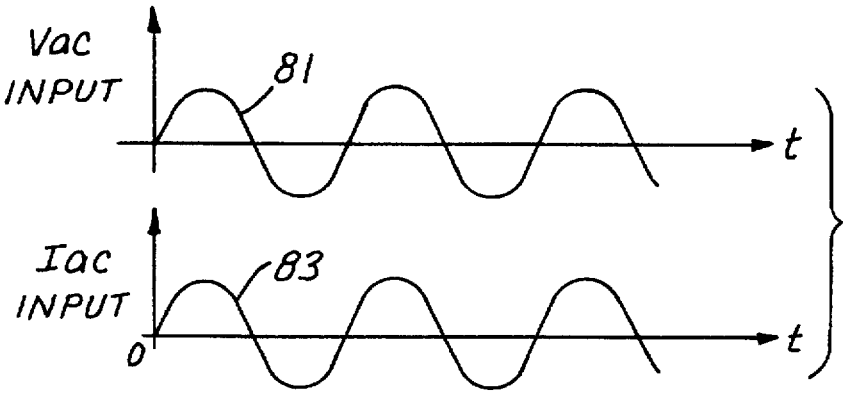
FIG. 7 is a graph illustrating a waveform for the input line voltage and line current.

The power factor circuit 65 is of the type which operates in the average current mode. It is connected to receive the input power from the distribution conductor 27 which provides input voltage and current with a neutral conductor 78. The input voltage and current waveforms can be alternating, as illustrated by the waveforms 81 and 83 of FIG. 7; alternatively, the input power can be provided in the form of a direct current on the distribution conductor 27.

This input power can be introduced across a transformer having windings 85 and 87, with an input capacitor 90 connected therebetween. In combination, the transformer windings 85, 87 and the capacitor 90 form an electromagnetic interference (EMI) filter 91 which provides attenuation of both internal and external "electronic noise."

Figure 8:
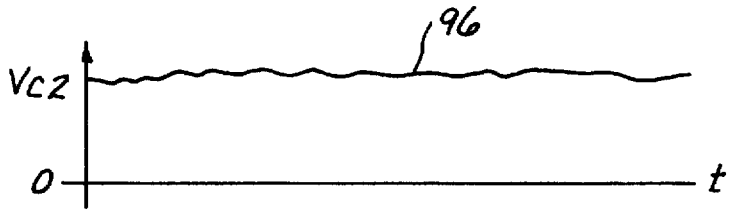
FIG. 8 is a graph illustrating a waveform for the voltage across an output capacitor in the power factor circuit.

The voltage across the input capacitor 90 is introduced to a full input bridge designated by the reference numeral 92. The output of the bridge 92 is provided between conductors 94 and 95 and is illustrated as a waveform 96 in FIG. 8. The connector 94 is connected through an inductor 98, a terminal 99, and a diode 100 to an output terminal 101. The conductor 95 at the opposite end of the bridge 92 is connected through a resistor 103 and a terminal 104 to a ground terminal 105. A switching member, which may be in the form of a field effect transistor (FET) 106 is connected between the terminals 99 and 104. An output capacitor 107 is connected between the output terminals 101 and 105 and has a voltage waveform such as that designated by the reference numeral 108 in FIG. 8. This voltage across the capacitor 107 provides an input to the inverter 67.

An input current control loop, formed by the inductor 98 the capacitor 107, the resistor 103 and the controller 76, has a high bandwidth to accurately follow the wave shape of the full-wave rectified line voltage. By sensing and controlling the average current value, rather than the peak, current distortion is maintained at a low level over the full range of input voltage and load variations.

Another feedback control loop formed by the capacitor 107 and the controller 76, senses the output voltage across the capacitor 107 and maintains it at a constant level by regulating the line current as required by the changing load. This feedback loop has a bandwidth which minimizes current waveform distortion caused by voltage ripple.

In a preferred embodiment of the power factor circuit 65 an average current mode controlled boost topology is chosen in order to provide high power quality sufficient to meet the increasing demand for high frequency lighting, power factor standards and stringent EMI standards.

In the illustrated embodiment, the inverter 67 is of the high efficiency, phase shifted, zero voltage and zero current switching type. This inverter 67 is in the form of a full switching bridge having legs designated generally by the reference numerals 109 and 111. In the illustrated embodiment, the leg 109 includes a pair of switching members such as the FETs 110 and 112 which share a common terminal 114. The leg 111 includes a pair of switching members in the form of insulated gate bipolar transistors (IGBT) 115 and 116 which share a common terminal 118. These switching members 110–116 are also designated Q2, Q3, Q4 and Q5, respectively. Internal diodes 121 and 123 are disposed across the associated FETs 110 and 112 while external diodes 125 and 127 are disposed across the IGBTs 115 and 116. Both of the switching legs 109 and 111 are connected between the output terminals 101 and 105 of the power factor circuit 65.

Of particular interest to the present invention is a series/parallel resonant tank circuit designated generally by the reference numeral 134. This tank circuit 134 includes in series a capacitor 136, a capacitor 138 and an inductor 141 which are connected between the common terminals 114 and 118 of the respective legs 109 and 111. The values chosen for the capacitors 136, 138 and the inductor 141 provide the tank circuit 134 with a resonant frequency $F_r1$ discussed in greater detail below.

The output of the inverter 67 is taken across the capacitor 138 by a transformer including a primary winding 143 and a secondary winding 145. The secondary winding 145 is connected in series with a capacitor 147, and the series combination connected in parallel with the ballast, such as the ballast 45 and 50 associated with each of the light fixtures, such as the fixtures 38 and 43. Each ballast, such as the ballast 45, includes a second tank circuit 150 including the series combination of a fuse 152, an inductor 154, a capacitor 156, and a capacitor 158. The lamps 12 are connected across the capacitor 156. The tank circuit 150 has a resonant frequency $F_r2$ which is of particular interest to the present invention as discussed in greater detail below.

In operation, the switching member comprising the FET 106 in the power factor circuit 65 is gated by the controller 76 through a line 161. Similarly, the switching members comprising the FETs 110, 112 and the IGBTs 115 and 116 in the inverter 67 are gated by the controller 76 through a line 163.

Figure 9:
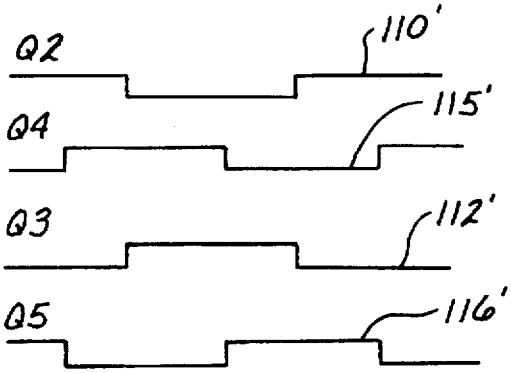
FIG. 9 includes four graphs of waveforms showing gate control voltages for switching members Q2, Q4, Q3, and Q5.

It will be noted that operation and control of the switching bridge in this embodiment differs from conventional resonant inverters in that the switching members 112–116 forming each leg 109, 111 of the bridge are switched on and off in a complimentary manner. Thus, in a preferred embodiment, each of the switches 110–116 in each leg 109, 111 is operated at a constant duty cycle which approaches 50% in a preferred embodiment, a small amount (for example 5%) of dead time is introduced for the zero voltage switching action to take place. The control waveforms for a preferred embodiment are illustrated in FIG. 9 and designated by the reference numerals 110', 112', 115' and 116' for the respective switching members Q2, Q4, Q3, and Q5. From these waveforms 110'–116' it can be seen that the switching members 110, 112 in the leg 109 are clocked on and off alternatively. Similarly, the switching members 115 and 116 in the leg 111 are clocked on and off alternatively in the same frequency as the clocking associated with the first leg 109. However, it will be noted that the control waveforms 115' and 116' associated with the leg 111, is out of phase with the waveforms 110' and 112' associated with the leg 109. This phase difference may vary in a range between 0° and 180° but in the preferred embodiment, the control waveforms 115' and 116' for the second leg 111 are 95 degrees out of phase with the control waveforms 110' and 112' of the first leg 109.

As noted, the control frequency is the same for both of the legs 109 and 111. This frequency is referred to as the switching frequency $F_s$ and for reasons described in greater detail below is greater than the resonant frequency $F_r1$ associated with the tank circuit 134 but less than the resonant frequency $F_r2$ associated with the ballast tank circuit 150.

Figures 10, 11, 12, 13, 14:
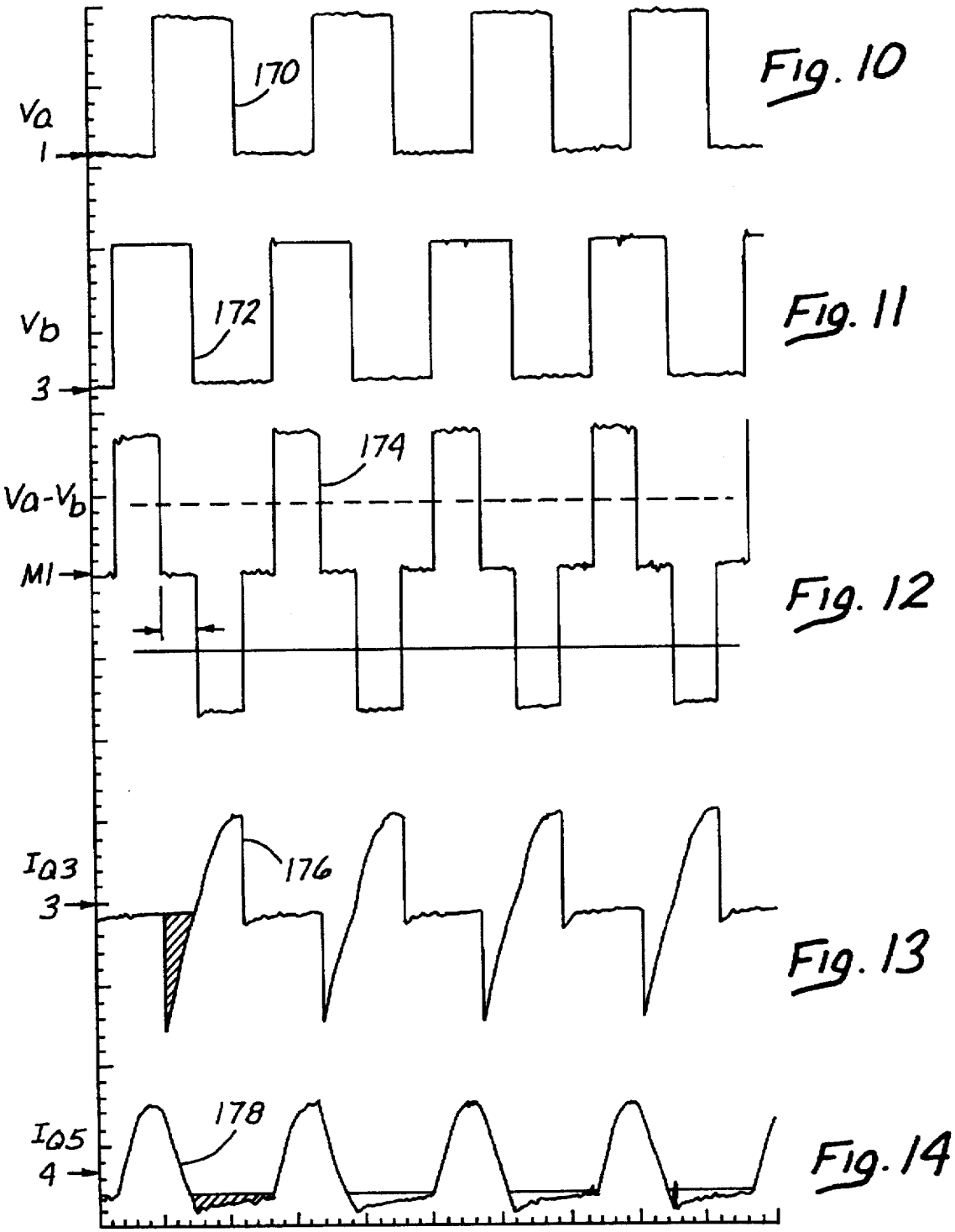
FIG. 10 is a graph showing a waveform at a point $V_A$ in the inverter of FIG. 3.
FIG. 11 is a graph illustrating a waveform at a point $V_B$ in the inverter of FIG. 3.
FIG. 12 is disposed between FIGS. 8 and 9 to better illustrate a graph showing a waveform for $V_A$ minus $V_B$ which is applied across a series/parallel resonant circuit in the inverter of FIG. 3.
FIG. 13 is a graph illustrating a waveform for current through a switching member $Q_3$ illustrated in the inverter of FIG. 3.
FIG. 14 is a graph illustrating a waveform for the current passing through a switching member $Q_5$ illustrated in the inverter of FIG. 3.

With these switching characteristics, a voltage $V_A$ on the common terminal 114 appears as a waveform 170 as illustrated in FIG. 10. Similarly, a voltage $V_b$ on the common terminal 118 appears as a waveform 172 as illustrated in FIG. 11. It follows that the voltage between the common terminals 114 and 118, which appears across the tank circuit 134 is equal to $V_A$ minus $V_B$ and has as a waveform 174 in FIG. 12. Comparing the waveform 174 to the waveforms 170 and 172, it can be seen that the voltage across the tank circuit 134 has a frequency as well as a phase which can be adjusted by merely controlling the phasing of the control waveforms 110'–116' (illustrated in FIG. 9) of the switching members 110–116, respectively. These variations of course control the frequency and magnitude of the power output signal across the capacitor 138.

The amplitude of the output power signal is regulated by phase-shifting the switches 115, 116 in the right leg 111 relative to the switching members 110, 112 in the left leg 109. During the time period when only one of the switching members in each diagonal is on, for example the switching members 101 and 116 or the switching members 112 and 115, the voltage across the resonant tank is clamped to zero. This results in a quasi square wave form which is applied to the tank circuit 134.

Both series resonant and parallel resonant inverters have been used in the past art with varying degrees of success. A series resonant inverter is highly load dependent making its application over a wide load range somewhat difficult. On the other hand it does not produce losses as a result of a circulating current between the tank and the bridge circuit. Parallel resonant inverters can be designed to provide good attenuation of high frequency harmonics from no load to full load. They can also be designed to have very low load sensitivity. However, the high attenuation of harmonics and the load insensitivity of the parallel resonant inverters requires a high circulating current which results in low system efficiency.

The present invention combines the strength of both the series and parallel inverters while eliminating the weaknesses of both. In order to achieve zero voltage switching and, at the same time reduce circulating currents, the inverter 67 is operated above or near resonant frequency. Although zero voltage switching can be achieved when the switching frequency is above the resonant frequency, this zero voltage switching cannot be attained over a wide load range.

The typical losses in a power inverter can be divided into two classes, conduction losses and switching losses. When in the conduction mode, both FETs (such as those forming the switching members 110 and 112) and IGBTs (such as those forming the switching members 115 and 116) have a finite channel resistance. Switching action in the presence of high currents and high voltage produces both switching losses and capacitive discharge losses. Although zero voltage switching is the most desirable switching condition for an FET or IGBT, the price paid to maintain the zero voltage switching over a wide load range is increased circulating current and commensurate power losses in the switching members. To overcome this problem, both zero voltage switching and zero current switching is implemented in the best mode of the present invention. Zero voltage switching occurs in the FETs 110, 112 forming the leg 109 while zero current switching occurs in the IGBTs 115, 116 forming the leg 111 in FIG. 3.

In a preferred embodiment of the invention, the auxiliary DC bias circuit 69 is connected across the IGBT 116 of the inverter 67. This circuit 69 includes capacitor 179, a magnetizing inductor 180 which extends the zero voltage switching of the leg 111. This circuit 69 also includes a fast recovery diode bridge 181 which provides a regulated DC voltage to the controller 76.

It will be understood that an auxiliary DC bias circuit, such as the circuit 69, can be used with either of the legs 109, 111. When connected to a leg including FETs, such as the leg 109 in FIG. 3 and the legs 109 and 111 in FIG. 4, zero voltage switching of that leg is extended.

In a typical inverter using IGBTs, the turn off switching losses are considerably higher owing to slow switching characteristics and tail current problems. However, external capacitors can be added to the circuit to reduce the turn off losses. In accordance with the present invention, the auxiliary DC bias circuit 69 can be connected across the IGBT 116 and provided with the external capacitor 179. In accordance with the present invention, the IGBT leg 111 in FIG. 3 is zero-current switched causing the turn-off losses to be completely zero with no tail current problems.

Figure 4:
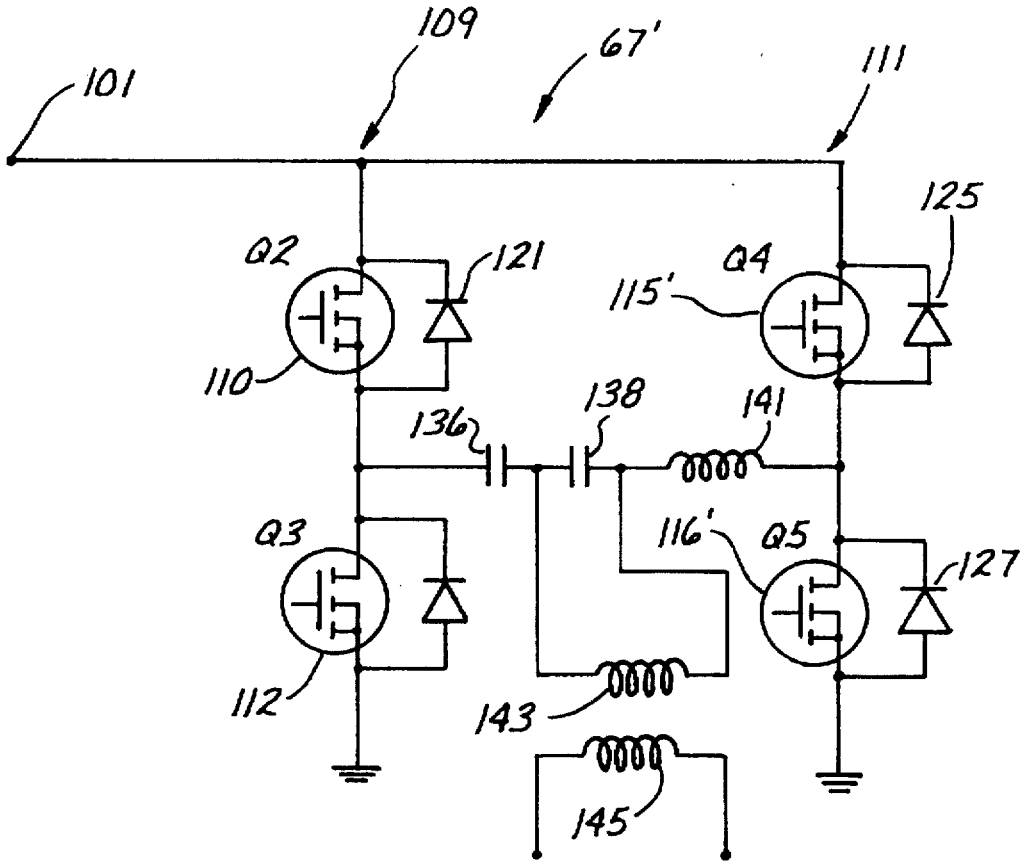
FIG. 4 is a schematic illustrating an alternative embodiment for an inverter included in the lighting server illustrated in FIG. 3.

A further embodiment of the inverter 67 is illustrated in FIG. 4 and designated by the reference numeral 67'. In this embodiment, all of the switching members 110–116 are FET switches. Thus, compared to the embodiment of FIG. 3, the IGBT transistors 115 and 116 in the leg 111 of FIG. 3 are replaced by FET transistors 115' and 116' in FIG. 4.

The zero voltage and zero current switching which provides the high efficiency characteristics of the inverter 67 can best be understood with reference to FIGS. 13 and 14 which illustrate waveforms 176 and 178 for the current passing through the switching members 112 and 116, respectively.

Figure 15:
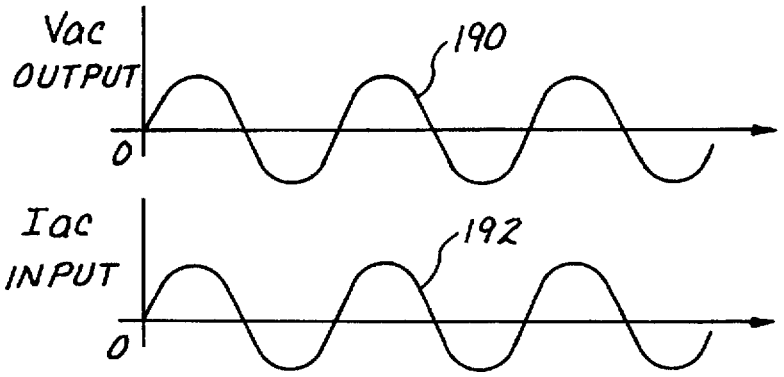
FIG. 15 is a graph showing illustrating waveforms for the power signal output from the inverter.

The resulting alternating current waveforms for voltage $V_{ac}$ Output and current $I_{ac}$ Output, which appear across the capacitor 138 in the tank circuit 134, are illustrated in FIG. 15 and designated by the reference numerals 190 and 192, respectively.

It will be noted that the lighting server 61 is particularly adapted for use in a system for retrofitting existing lamps 12 and their associated ballasts, such as the ballast 43–50. This system also takes advantage of existing wiring which limits not only the cost of manufacture, but also the cost of installation. In order to minimize the skin and proximity effects, the power output of the inverter 67 is preferably provided in a range between 20 and 25 kilohertz and at a voltage less than about 600 volts AC. This is the minimum voltage rating of wiring commonly used in existing distributive lighting circuits. Due to the relatively low frequency and high voltage operation of the system, the current can be maintained within these existing wire specifications. With the retrofit system, the lamp ballasts 45–50 provide adequate voltage and high impedance to start and regulate the lamps 12 while providing continuous cathode heater voltages to the lamps 12 throughout the dimming range.

Of particular interest to the present invention is the operation of the lighting server 61 in response to an open circuit condition associated with the lamps 12. Under normal conditions, when the lamps 12 are illuminated, they provide a closed circuit through the lamps to accommodate the normal flow of a dimming current. However, when an open circuit condition occurs—for example when one or more of the lamps 12 is not inserted properly, or will not start because its cathode is broken, or has a gas leak—the lamp 12 forms an open circuit across the associated ballast 45 or 50. With the lamps in an open circuit state, the inductor 154 and the capacitor 156 immediately resonate at their natural frequency $F_r2$. This significantly lowers the impedance of the ballast thereby resulting in a large circulating current and a commensurate instantaneous power dissipation.

Figure 5:
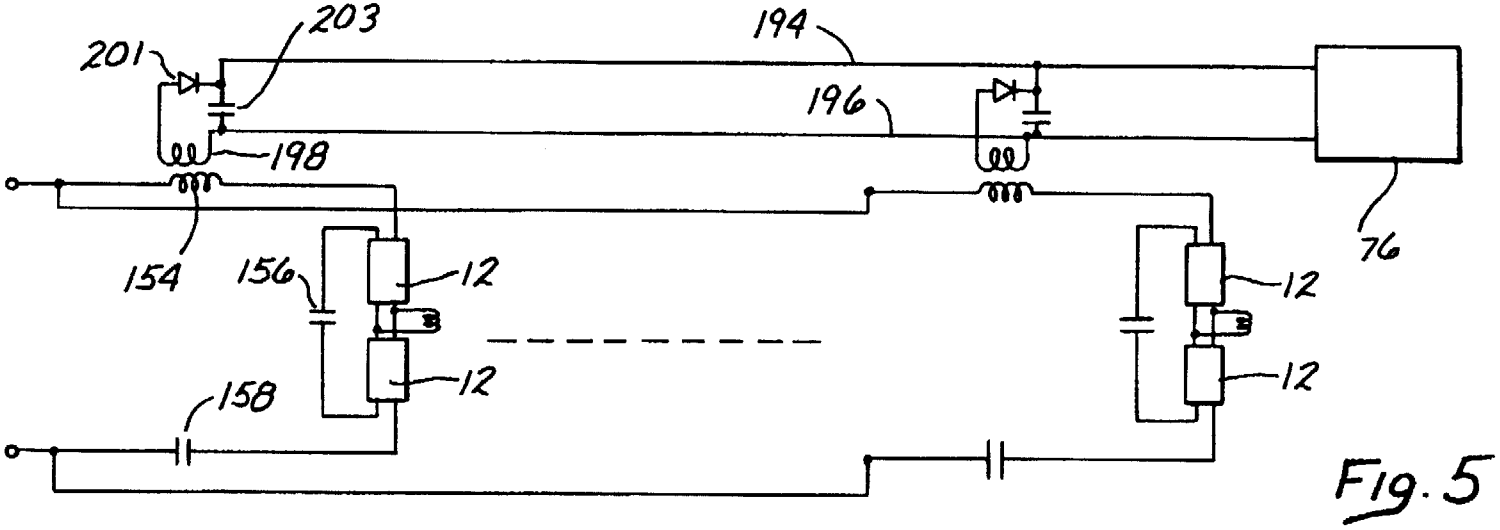
FIG. 5 is a schematic view of multiple lighting circuits and associated ballasts including a DC bus for detuning the ballast under open circuit conditions.
Figure 6:
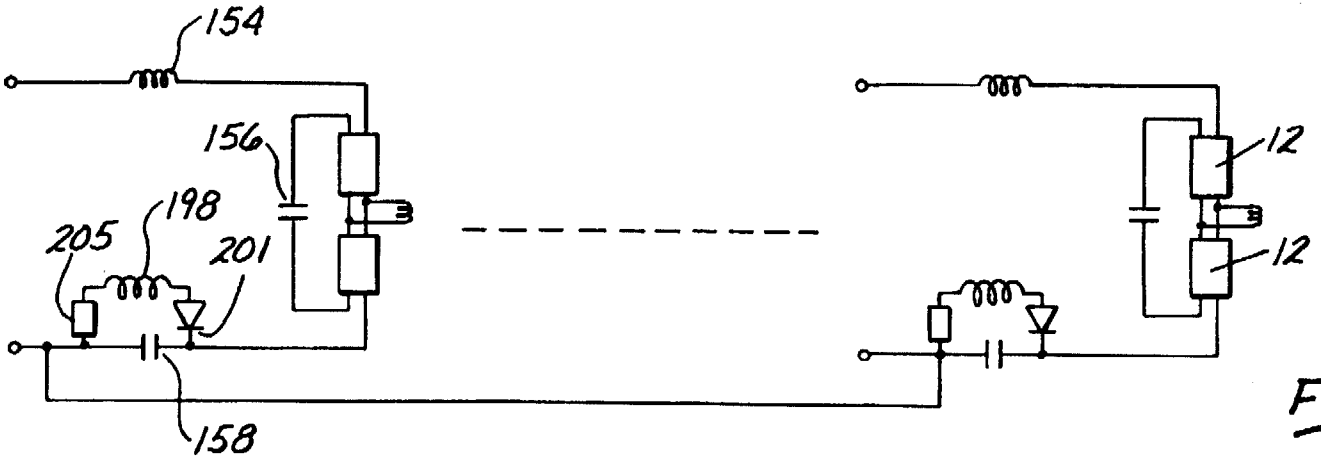
FIG. 6 is a schematic similar to FIG. 5 and illustrating a high frequency line DC offset for detuning the lamp ballast under open circuit conditions.

To reduce this power consumption and avoid the damaging high circulating current, protection circuits, such as those illustrated in FIGS. 5 and 6 can be implemented. The circuit of FIG. 5 provides a low voltage DC bus in the form of conductors 194 and 196. In this circuit, the inductor 154 in the tank circuit 150 takes the form of a primary winding in a transformer having a secondary winding 198. This winding 198 is connected in series with a diode 201, and a capacitor 203 which is connected between the conductors 194 and 196.

In operation, the open circuit current, which increases through the inductor 154 is reflected into the secondary winding 198 which applies a charging voltage across the capacitor 203. It is this charge on the capacitor 203 which provides an alert signal which is communicated through the conductors 194, 196 of the DC bus into to the controller 76. In response to the alert signal, the controller 76 can adjust the pulse width and frequency of the power signal output by the inverter 67. This adjustment will effectively detune the ballast tank circuit 150 to instantaneously reduce the open circuit circulating current and the associated power dissipation in the ballast 45. In this embodiment, the capacitor 156 forms a first capacitor while the capacitor 203 forms a second capacitor the charge on which is sensed by the controller 76.

Another active approach to the open circuit problem is illustrated in FIG. 6. In this case, the secondary winding 198 together with the series combination of the diode 201 and a resistor 205, is connected across the capacitor 158. Again, as the open circuit circulating current rises in the inductor 154, this is reflected in the secondary winding 198 and places a charge on the capacitor 158. This charge on the capacitor 158 results in a equal and opposite charge on the capacitor 147 which is illustrated in series with the winding 145 in FIG. 3. The voltage across the capacitor 147 is sensed by the controller 76 through the line 163 which appropriately adjusts the phase and/or frequency of the power output to detune the tank circuit 150 of the ballast 45. In this embodiment, the capacitor 156 forms a first capacitor while the capacitor 158 forms a second capacitor the charge on which is sensed by the controller 76 which monitors a corresponding voltage on a third capacitor 147.

With both of the protection schemes described with reference to FIGS. 5 and 6, the open circuit condition is sensed and the controller 76 makes an active adjustment to the output power of the inverter 67.

Figure 16:
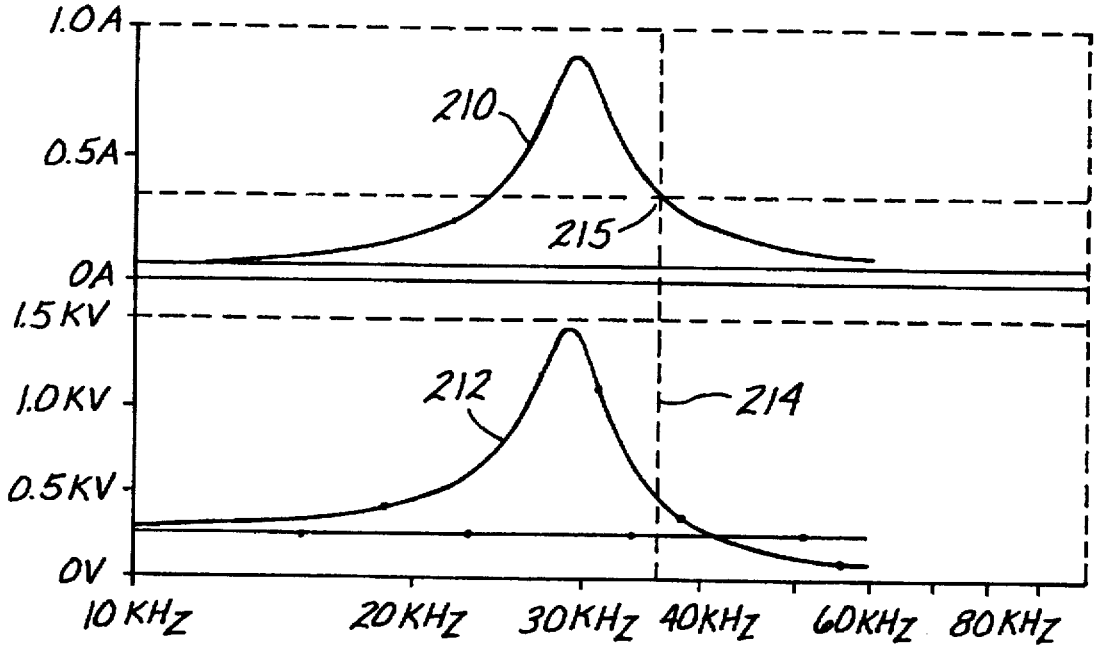
FIG. 16 is a graph illustrating current and voltage gain waveforms in a ballast tank circuit where a switching frequency is chosen below or above the resonant frequency of the ballast tank circuit.

In a further protection scheme, a passive adjustment results from merely selecting a switching frequency which is less than the resonant frequency of the ballast 45. This does not affect the zero current and zero voltage switching of the inverter 67 which has its own tank circuit 134 providing a resonant frequency $F_r1$ less than the switching frequency. The advantage which this choice of switching frequency provides over the systems of the prior art can best be understood with reference to the current and voltage gain waveforms illustrated in FIGS. 16 and 17. For example, in FIG. 16 a waveform 210 illustrates the current gain of the ballast 45 while a waveform 212 illustrates the voltage gain for the ballast.

In the past, the switching frequency was chosen to be greater than the resonant frequency of the lamp ballast. This was required in order to accommodate the zero voltage switching in the inverters of the prior art. Accordingly, the lamp ballast of the prior art operated to the right of the peaks in the associated waveforms 210 and 212.

If, for example, the input power was 300 volts AC, and the desired output power was 450 volts AC, a voltage gain of 1.5 was required. This required a decrease in the switching frequency sufficient to raise the output voltage to 450 volts AC as shown by the intersection of the waveform 212 and a dotted line 214. Extending this dotted line 214 into the waveform 210 indicates that the circulating current in the lamp ballast might have an amplitude such as 342 milliamps, as shown by the intersection 215 between the waveform 210 and the dotted line 214.

Figure 17:
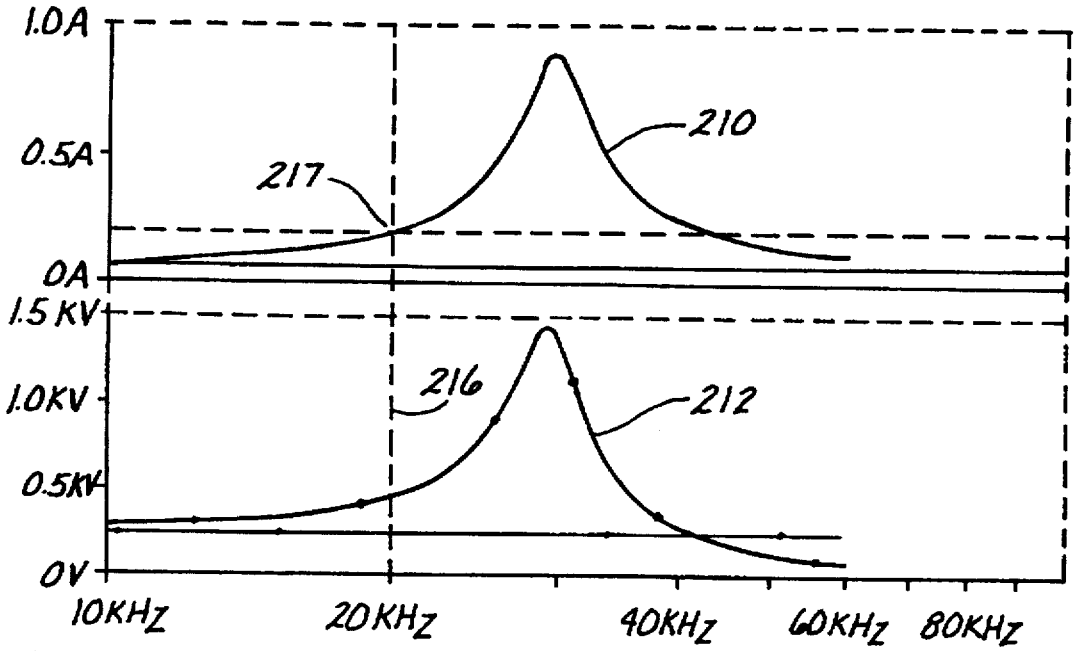
FIG. 17 is a graph illustrating current and voltage gains for a ballast tank circuit where the switching frequency is chosen below the resonant frequency of the ballast tank circuit.

Turning now to FIG. 17 and the present invention, it will be shown that when the inverter 67 is operated at a switching frequency less than the resonant frequency $F_r2$ of the tank circuit 150, the circulating current in the ballast 45 can be significantly reduced. In this case, the desired output voltage of 450 volts AC in the above example is achieved to the left of the peaks in the waveforms 210 and 212 where the switching frequency is less than the reference frequency $F_r2$. As illustrated, the desired output of 450 volts AC occurs where the waveform 212 intersects a dotted line 216. Extending this dotted line 216 to an intersection 217 with the current gain curve 210 indicates that the circulating current is only 193 milliamps.

A comparison of the currents at the intersections 215 and 217 shows that the circulating current of the present invention is reduced by a factor of 1.77 equal to the current (342 milliamps) at the intersection 215 divided by the current (193 milliamps) at the intersection 217. Since the open circuit losses result in power dissipation which is the square of the circulating current, it can be shown that for this example the power dissipation is reduced by 1.77 squared, or approximately 3. It follows that instantaneous power dissipation losses which are at the core of the open circuit problem are automatically and passively reduced to only one-third of the open circuit losses associated with the prior art.

In a further aspect of the present invention, the wall switch 54 illustrated in FIG. 2 is coupled through low voltage wiring 221 to the lighting server 61 including the controller 76. When the wall switch 54 is open to extinguish the lamps 12 in the zone 14, the controller 76 responds by placing the switching member 106 of the power factor circuit 65 and the switching members 110–116 of the inverter 67 in a non-conductive state. With all of the switching members 106, 110–116 effectively providing an open circuit condition, the output power signal of the inverter 67 goes to zero and the lamps 12 are accordingly extinguished. When the wall switch 54 is turned on, the switching members 106, 110–116 are placed in the operative state and the lamps 12 are activated.

In this scheme for turning the lamps on and off, the output capacitor 107 of the power factor circuit 65 remains in a charged state. Even though the switching members 106, 110–116 are deactivated when the switch 54 is turned off, the input power of the power factor circuit 65 keeps the output capacitor 107 charged. As a result, when the switching members 106, 110–116 are again placed in the operative state, a large in rush current is avoided. This not only increases the reliability of the lighting server 61 but also provides the wall switch 54 with a safer low voltage input.

Pulse width modulation controls the amplitude of the output power signal in a dimming range of 100% down to 40% of maximum light output. Variable frequency control is used for dimming the lamp from 40% to 15% of maximum light output. This variable control strategy helps maintain the zero voltage switching for the leg 109 of the inverter 67 under light load conditions.

Given these wide variations, which are all within the scope of this concept, one is cautioned not to restrict the invention to the embodiments which have been specifically disclosed and illustrated, but rather encouraged to determine the scope of the invention only with reference to the following claims.

I claim:

1. A lighting system responsive to input power for controlling operation of a discharge lamp having an "on" state and an "off" state, the system comprising:

a power factor control circuit receiving the input power and including an output capacitor having a charged condition associated with a low in-rush current and a discharged condition associated with a high in-rush current;

a lamp circuit including the discharge lamp;

an inverter coupled to the output capacitor in the power factor control circuit and coupled to the lamp circuit, the inverter providing the lamp circuit with a power signal having first characteristics and second characteristics, the lamp circuit being responsive to the first characteristics of the power signal to place the discharge lamp in the "on" state and being responsive to the second characteristics of the power signal to place the discharge lamp in the off state; and means for providing the power signal of the inverter with the second characteristics while maintaining the output capacitor of the power factor control circuit in the charged condition to place the discharge lamp in the "off" state while avoiding the high in-rush current.

2. The lighting system recited in claim 1, wherein the providing means comprises:

a plurality of switching members included in the inverter, each of the switching members having a conductive state providing the power signal with the first characteristics and an other state providing the power signal with the second characteristics; and a controller having properties for placing all of the switching members in the other state to provide the power signal with the second characteristics and to place the lamp in the "off" state.

3. The lighting system recited in claim 2 wherein:

the switching members include a plurality of field effect transistors arranged in a full bridge; and the field effect transistors are responsive to a voltage across the bridge.

4. The lighting system recited in claim 3 wherein:

the bridge includes a first leg and a second leg;

the field effect transistors are included in the first leg of the bridge and are responsive to a voltage across the first leg of the bridge to switch between the conductive state and the other state.

5. The lighting system recited in claim 4 further comprising:

a plurality of insulated gate bipolar transistors disposed in the second leg of the bridge and responsive to the current through the second leg of the bridge to switch between the conductive state and the other state.

6. The lighting system recited in claim 1 wherein the providing means includes a wall switch operable to provide the inverter with the second characteristics.

* * * * *